US011096416B2

(12) United States Patent
Esposti et al.

(10) Patent No.: US 11,096,416 B2
(45) Date of Patent: Aug. 24, 2021

(54) MACHINE AND METHOD FOR PRODUCING SUBSTANTIALLY CYLINDRICAL ARTICLES OF THE TOBACCO PROCESSING INDUSTRY

(71) Applicant: G.D SOCIETA' PER AZIONI, Bologna (IT)

(72) Inventors: Marco Esposti, Casalecchio di Reno (IT); Ivan Eusepi, Castelmaggiore (IT); Nicola Baldanza, Zola Predosa (IT); Massimo Sartoni, Bologna (IT)

(73) Assignee: G.D SOCIETA' PER AZIONI, Bologna (IT)

( * ) Notice: Subject to any disclaimer, the term of this patent is extended or adjusted under 35 U.S.C. 154(b) by 386 days.

(21) Appl. No.: 15/126,008

(22) PCT Filed: Mar. 20, 2015

(86) PCT No.: PCT/IB2015/052065
§ 371 (c)(1),
(2) Date: Sep. 14, 2016

(87) PCT Pub. No.: WO2015/140769
PCT Pub. Date: Sep. 24, 2015

(65) Prior Publication Data

US 2017/0086495 A1 Mar. 30, 2017

(30) Foreign Application Priority Data

Mar. 21, 2014 (IT) ..... BO2014A000148

(51) Int. Cl.
*A24D 3/02* (2006.01)

(52) U.S. Cl.
CPC ..... *A24D 3/0225* (2013.01); *A24D 3/0245* (2013.01)

(58) Field of Classification Search
CPC ..... A24D 3/0245; A24D 3/0225
(Continued)

(56) References Cited

U.S. PATENT DOCUMENTS 3,570,557 A * 3/1971 Molins ..... A24D 3/0225 118/308
3,807,286 A * 4/1974 Sexstone ..... A24D 3/0225 493/45

(Continued)

FOREIGN PATENT DOCUMENTS

WO WO-2007/138487 A2 12/2007
WO WO-2013/022360 A2 2/2013

OTHER PUBLICATIONS

International Search Report for International Patent Application No. PCT/IB2015/052065, filed Jul. 28, 2015.

*Primary Examiner* — Anna K Kinsaul
*Assistant Examiner* — Daniel Jeremy Leeds
(74) *Attorney, Agent, or Firm* — Marshall, Gerstein & Borun LLP

(57) ABSTRACT

Machine and method for producing substantially cylindrical articles of the tobacco processing industry; a material with cavities is fed, along a given path, through an insertion station, where powder material is inserted into the cavities, so as to obtain a strand, and through a wrapping station, in the area of which a strip is wrapped around the strand; the powder material is inserted into each cavity by a relative insertion unit, which moves in a synchronous manner along a coupling portion of the given path.

14 Claims, 8 Drawing Sheets

(58) Field of Classification Search
USPC ..... 493/39–44
See application file for complete search history.

(56) References Cited

U.S. PATENT DOCUMENTS 5,542,901 A * 8/1996 Atwell ..... A24D 3/0225 131/61.1
6,837,281 B2 * 1/2005 Spiers ..... B65B 1/366 141/125
7,381,175 B2 * 6/2008 Dawson ..... A24D 3/0216 493/47
7,740,019 B2 * 6/2010 Nelson ..... A24D 3/0229 131/365
8,303,474 B2 * 11/2012 Iliev ..... A24D 3/061 493/47
8,308,623 B2 * 11/2012 Nelson ..... A24D 3/061 131/84.1
8,992,400 B2 * 3/2015 Righetti ..... A24D 3/0295 493/39
9,161,571 B2 * 10/2015 Sikora ..... A24D 3/0225
9,573,707 B2 * 2/2017 Owczarek ..... B65B 5/068
2002/0119874 A1 * 8/2002 Heitmann ..... A24C 5/475 493/39
2003/0034590 A1 * 2/2003 Ercelebi ..... A24D 3/0225 264/518
2006/0196513 A1 * 9/2006 Atwell ..... A24C 5/475 131/58
2007/0284012 A1 * 12/2007 Smith ..... A24D 3/0225 141/1
2009/0036284 A1 * 2/2009 Spiers ..... A24D 3/0225 493/47
2012/0252647 A1 * 10/2012 Pastore ..... A24C 5/28 493/39
2013/0019885 A1 * 1/2013 Belcastro ..... A24C 5/475 131/280
2013/0029821 A1 * 1/2013 Hoffmann ..... A24D 3/0287 493/4
2013/0167851 A1 * 7/2013 Ademe ..... A24C 5/472 131/280
2014/0263408 A1 * 9/2014 Amiss ..... G01F 11/46 222/1

* cited by examiner

MACHINE AND METHOD FOR PRODUCING SUBSTANTIALLY CYLINDRICAL ARTICLES OF THE TOBACCO PROCESSING INDUSTRY

CROSS-REFERENCE TO RELATED APPLICATIONS

This is the U.S. national phase of International Application No. PCT/IB2015/052065, filed Mar. 20, 2015, which claims the benefit of Italian Patent Application No. BO2014A000148, filed Mar. 21, 2014.

TECHNICAL FIELD

The present invention relates to a machine and a method for producing substantially cylindrical articles of the tobacco processing industry.

BACKGROUND ART

American patents U.S. Pat. Nos. 6,837,281 and 3,570,557 describe systems for manufacturing composite cigarette filters, wherein portions of filtering material (usually cellulose acetate tow), alternated with cavities, are fed, along a given path and in a conveying direction, through an insertion station, in the area of which a given amount of particulate material is inserted into the cavities, so as to obtain a strand. The particulate material is fed by a hopper, which is arranged above a transfer drum, which is provided with peripheral seats, each designed to receive an amount of material and transfer it into a respective cavity.

The filter rod obtained by wrapping a strip around the strand produced with this kind of systems has proved to be unstable and tends to open longitudinally relatively frequently. Furthermore, during the operation of this kind of systems, a relatively large amount of particulate material is dispersed in the room, thus potentially damaging parts of the cigarette manufacturing machine, which, as a consequence, requires maintenance and relatively frequent interruptions of the operation.

In addition, the particulate material dispersed in the room is also potentially dangerous for the operators working on the machine or close thereto. In this regard, an increasing number of clinical trials have proved that people who work in facilities with a high concentration of particulate in the air will most likely develop some specific diseases (for example, cancer).

Patent application no. WO2013/022360 discloses a machine to manufacture multi-segment filters, which comprises an insertion assembly to feed loose material into spaces defined in a succession of portions of filtering material. The insertion assembly comprises a plurality of seats, each designed to feed a respective amount of loose material into the aforesaid spaces. In use, the loose material enters the seats thanks to a sucking system and to the action of scrapers that lift the loose material from a conveyor belt.

The machine described in WO2013/022360 has many drawbacks, among which (in addition to the ones already mentioned above) there is also the impossibility to precisely control the amount of loose material inserted into the spaces.

DISCLOSURE OF INVENTION

The object of the present invention is to provide a machine and a method, which are designed to at least partially eliminate the drawbacks of the prior art and, at the same time, are cheap and easy to manufacture and carry out.

According to the present invention, there are provided a machine and a method for producing substantially cylindrical articles of the tobacco processing industry, as claimed in the accompanying independent Claims and, preferably, in any one of the Claims that directly or indirectly depend on the aforesaid independent Claims.

BRIEF DESCRIPTION OF THE DRAWINGS

The present invention will now be described with reference to the accompanying drawings, which show a non-limiting embodiment thereof, wherein.

BEST MODE FOR CARRYING OUT THE INVENTION

Figure 1:
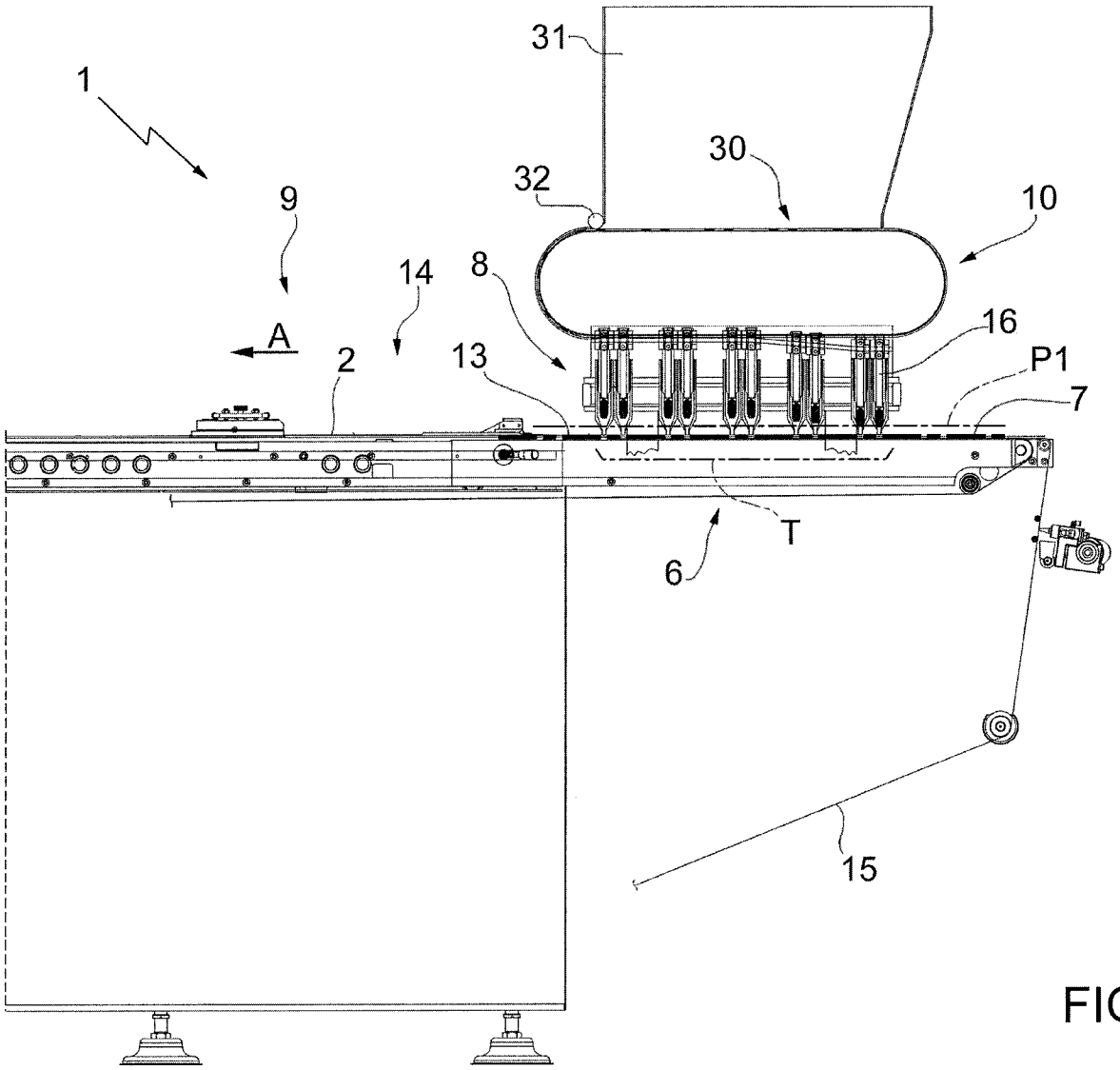
FIG. 1 is a lateral, schematic view, with some details removed for greater clarity and partly cross-sectional, of a machine according to the present invention.
Figure 8:
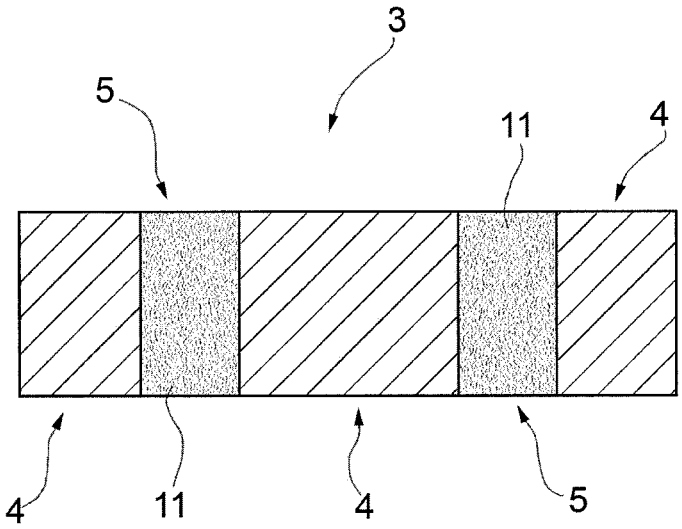
FIG. 8 is a longitudinal section of an article that can be produced with the method according to the present invention.

In FIG. 1, number 1 indicates, as a whole, a machine for producing a rod 2 for substantially cylindrical articles 3 of the tobacco processing industry. In particular, each article 3 (FIG. 8) has portions 4 and 5 of different materials.

The machine 1 (FIG. 1) comprises a feeding assembly 6 for feeding a material 7, in a conveying direction A along a first given path P1, through an insertion station 8 and to a wrapping station 9; an insertion assembly 10, which is located in the insertion station 8 to insert a given amount of a loose material 11 (shown in detail in FIG. 8) into cavities 12 of the first material 7 to form a strand 13, said cavities 12 being arranged in succession in the conveying direction A; and a wrapping assembly 14, which is located in the wrapping station 9 to wrap and stabilize a strip 15 around the strand 13.

In particular, the loose material 11 is in the form of particles and/or granules (and/or fibres). For example, the loose material 11 can comprise a filtering material and/or tobacco particles.

According to preferred embodiments, the articles 3 are cigarette filters and the material 7 comprises a filtering material, in particular cellulose acetate or the like.

According to other embodiments, the articles 3 are cigarette portions and the material 7 comprises tobacco.

Advantageously, the material 7 has portions of material that are arranged in succession in the conveying direction and alternate with the cavities 12.

Advantageously, the path P1 is substantially horizontal.

Figure 2:
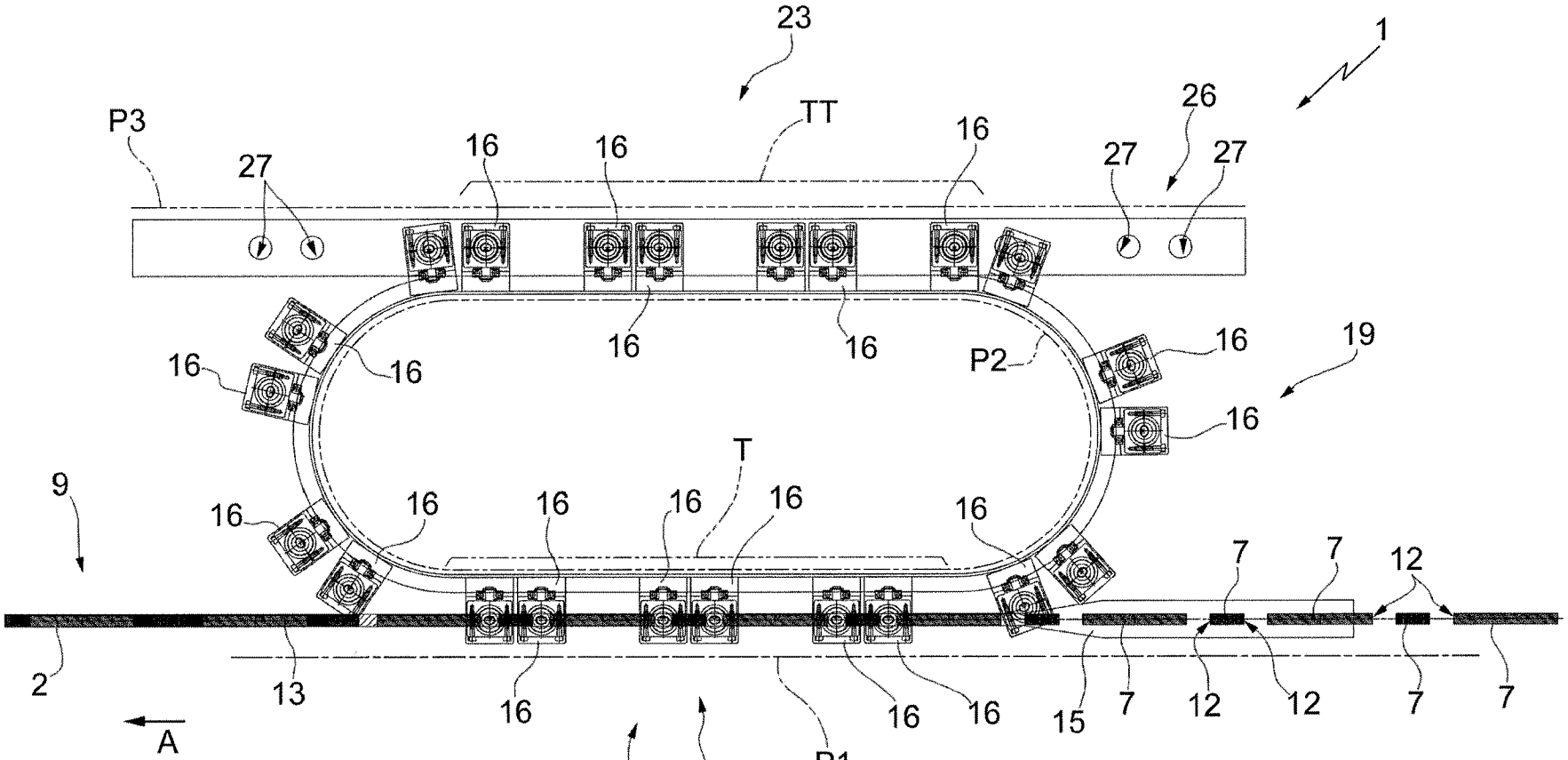
FIG. 2 is a view from above, with some details removed for greater clarity and on a larger scale, of a part of the machine of FIG. 1.
Figure 3:
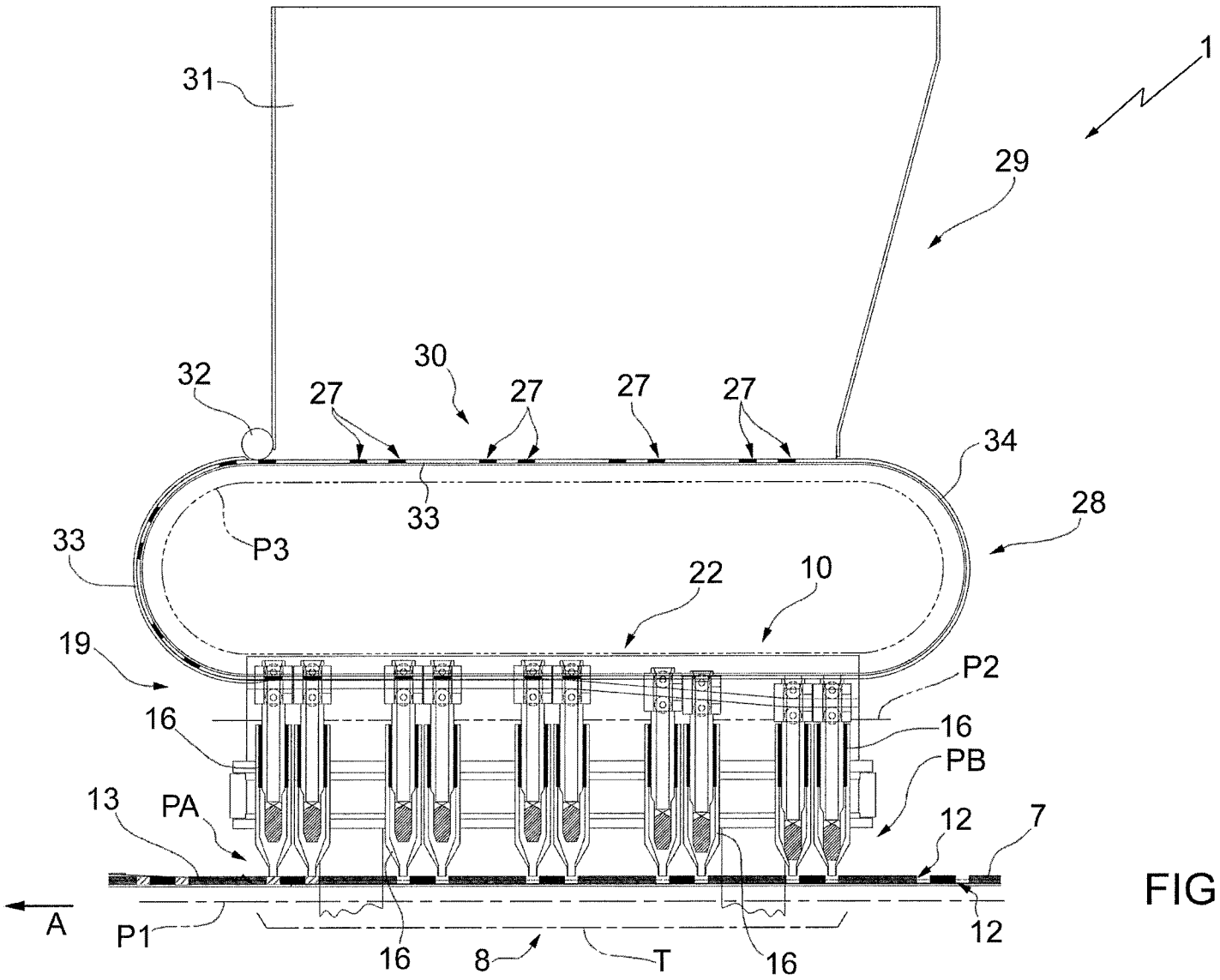
FIG. 3 shows a part of FIG. 1 on a larger scale.

With particular reference to FIGS. 2 and 3, the insertion assembly 10 comprises at least one insertion unit 16, which, in turn, comprises a loading chamber 17 to hold the given amount of loose material, and an unloading device 18 to unload the loose material 11 from the loading chamber 17; and a conveyor 19 for conveying the insertion unit 16, along a second given path P2, through the insertion station 8. The first and second given paths P1, P2 share (at least) a coupling portion T in the insertion station 8. The feeding assembly 6 and the conveyor 19 are designed so as to be operated in such a way that the unloading device 18 is kept facing a respective cavity 12 along (at least part of) the coupling portion T (as the insertion unit 16 and the material 7 are fed along the coupling portion T itself).

In this way, the loose material 11 can be better inserted into the cavities, thus reducing at the same time the risk that the loose material can spread in the room.

Experiments have shown that use of the machine 1 according to the present invention surprisingly allows manufacturers to improve the stability of the rod 2 obtained therewith. In this regard, we assume that this unexpected technical effect is due (as well) to the reduction of loose material 11 in the room. As a consequence of the result obtained, indeed, the conclusion was reached that the high tendency to open longitudinally was probably due to the fact that particles of the material 11 remained caught between the two longitudinal flaps of the strip 15 when they were caused to overlap.

Advantageously, the coupling portion T is at least 2.5 cm long. More precisely, the coupling portion T is at least 5 cm long. Even more precisely, the coupling portion T is at least 8 cm long. An adequate length allows the material 11 to have enough time to be inserted into the cavities 12 in a correct fashion.

Typically, the coupling portion T is up to 30 cm long.

Advantageously, the path P2 is substantially horizontal. In this way, the handling of the loose material 11 becomes easier and the risk of dispersing loose material 11 in room is further reduced.

Advantageously, the path P2 is a closed path. In this way, the insertion unit 16 can keep moving along the path P2 in a continuous manner, for as many times as requested, without the need to abruptly change the direction of its movement and/or stop the movement of the insertion unit 16 itself.

According to some embodiments, the unloading device 18 comprises an outlet opening 20, which is designed to allow the loose material 11 to move from the loading chamber 17 to the cavity 12, and a stopper 21.

The outlet opening 20 and the stopper 21 are movable with respect to each other between a first position PA, in which the outlet opening 20 is open, and a second position PB, in which the outlet opening 20 is closed by the stopper 21.

In FIG. 3, the first two insertion units 16 on the right are in the second position PB; the other two insertion units 16 are in the first position PA.

Advantageously, the outlet opening 20 faces downwards and is located in the area of a lower end of the loading chamber 17.

According to some embodiments (such as the ones shown in the drawings), the stopper 21 is (vertically) movable between the first (in particular, raised) position PA, in which it frees outlet opening 20, and the second (in particular, lowered) position PB, in which it closes the outlet opening 20.

Figure 4:
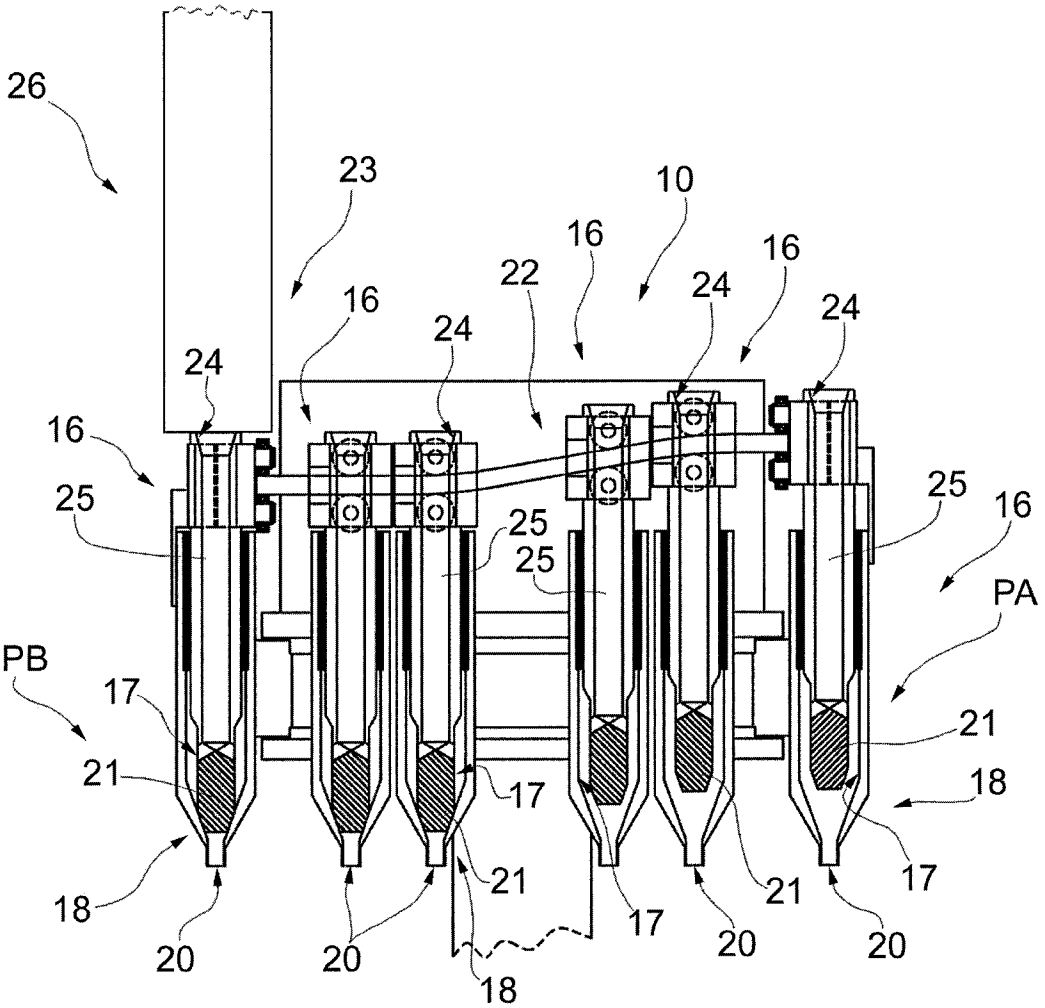
FIG. 4 is a front view, on a larger scale and with some details removed and partly cross-sectional for greater clarity, of a part of the machine of FIG. 1.

In these cases, the stopper 21 can be kept in the first position PA even in portions (for example, as shown on the right in FIG. 4) of the path P2 other than the coupling portion T. In these portions a periodic cleaning of the outlet opening 20 and of the loading chamber 17 by means of air jets, thus reducing the risk of creating obstructions, can be performed.

According to some embodiments (not shown), it is the opening 20 (more precisely, the outer casing of the loading chamber 17, wherein the opening 20 is obtained) that is (vertically) movable between the first (lowered) position PA and the second (raised) position PB.

In these cases, in the area of the coupling portion T, the opening 20 is lowered so that it can move closer to the cavity 12 (more precisely, it can be substantially inserted therein). By so doing, the loose material 11 is transferred into the cavity 20 in an even more precise manner, thus further reducing the chance for particles of loose material 11 to spread in the room.

According to further embodiments (not shown), both the opening 20 and the stopper 21 are vertically movable. In these cases, operators can obtain advantages linked to both the movement of the opening 20 and the movement of the stopper 21.

Advantageously, the insertion assembly 10 comprises a cam system 22, which is designed to keep the outlet opening 20 and the stopper 21 in the first position PA at least along part of said coupling portion T, and in the second position PB along the path P2 from a loading station 23, in the area of which the given amount of loose material 11 is transferred into the insertion unit 16, to the insertion station 8.

In particular, the insertion unit 16 also has a second (more specifically, top) opening 24, through which, in use, the given amount of loose material is fed into the loading chamber 17.

The loose material 11 fed through the opening 24, in use, moves downwards through the central channel of a hollow rod 25, at whose lower end there is mounted the stopper 21, and enters the loading chamber 17 by passing through openings of the rod 25 arranged in the area of the lower end of the rod 25 itself.

According to the embodiment shown, the cam system 22 comprises a (fixed) guide cam, which extends along the path P2, and a slide 25 (tappet), which is integral to the stopper 21 (in particular, is integral to the rod 25).

Advantageously, the machine 1 comprises a loading assembly 26, which is located in the loading station 23 to transfer the given amount of loose material 11 to the insertion unit 16. The given path P2 extends through the loading station 23.

According to some embodiments, the loading assembly 26 comprises at least one transfer seat 27, which has a given volume and is designed to house the given amount of loose material 11; and a conveyor 28 to convey the transfer seat 27 through the loading station 23 along a given path P3.

The given paths P2 and P3 share at least a transfer portion TT, which is located in the loading station 23 and in the area of which the transfer seat 27 is coupled to (more specifically, overlaps) the insertion unit 16, so as to transfer the given amount of loose material from the transfer seat 27 to the insertion unit 16.

In particular, the conveyors 28 and 19 are operated in such a way that the transfer seat 27 is kept facing the insertion unit 16 (more precisely, its opening 24) along (at least part of) the transfer portion TT (as the insertion unit 16 and the seat 27 are fed along the transfer portion TT itself).

Advantageously, the transfer portion TT is at least 2.5 cm long. More precisely, the transfer portion TT is at least 5 cm long. Even more precisely, the transfer portion TT is at least 8 cm long. An adequate length allows the material 11 to have enough time to be inserted into the cavities 12 in a correct fashion.

Typically, the transfer portion TT is up to 30 cm long.

Advantageously, the path P3 is a closed path. In this way, the transfer seat 27 can keep moving along the path P3 in a continuous manner, for as many times as requested, without the need to abruptly change the direction of its movement and/or stop the movement of the transfer seat 27 itself.

Advantageously, the path P3 is substantially horizontal. In this way, the handling of the loose material 11 becomes easier and the risk of dispersing loose material 11 in room is further reduced.

According to some embodiments, the machine 1 comprises a feeding device 29 for the loose material 11, which is located in the area of a metering station 30, through which the given path P3 extends. In particular, the feeding device 29 is designed to feed the loose material 11 to the transfer seat 27.

According to some embodiments, the feeding device 29 comprises a hopper 31. Advantageously, the hopper 31 has a lower opening, through which the loose material 11 is fed into the transfer seat 29. The conveyor 28 is designed to transport the transfer seat 27 under the aforesaid opening.

Advantageously, a scraper device 32, which is designed to eliminate possible excess loose material 11 available in the seat 27, is located along the path P3 immediately downstream from the hopper 31. In particular, the scraper device 32 comprises a rotary brush.

In particular, the transfer seat 27 has two opposite openings (an upper one and a lower one), which are designed to allow the loose material 11 to pass through.

Advantageously, the loading assembly 26 comprises at least one retaining assembly 33, which is designed to prevent the loose material 11 from going out of the transfer seat 27 and extends along the given path P3, from the metering station 30 to the loading station 23. In particular, the retaining assembly 33 is absent along the transfer portion TT (so as to allow the loose material to be transferred from the seat 27 to the insertion unit 16).

Advantageously, the feeding device 29 (in particular, the hopper 31) is offset relative to the (i.e., not directly above the) path P1 and relative to the (i.e., not directly above the) wrapping station 9.

This makes it even more difficult for particles of the loose material 11 to reach the strip 15.

According to some embodiments, in particular with reference to FIG. 3, the seat 27 is a hole made in a belt 34, which is conveyed along the given path P3, which extends at least partially vertically. Along the vertical portions of the path P3 there are provided guides, which extend in contact with the belt 34, so as to prevent the loose material 11 from going out of the seat 27. These guides (which act as retaining assembly 33) extend on the lower side of the belt along the entire path P3, except for the transfer portion TT.

Figure 5:
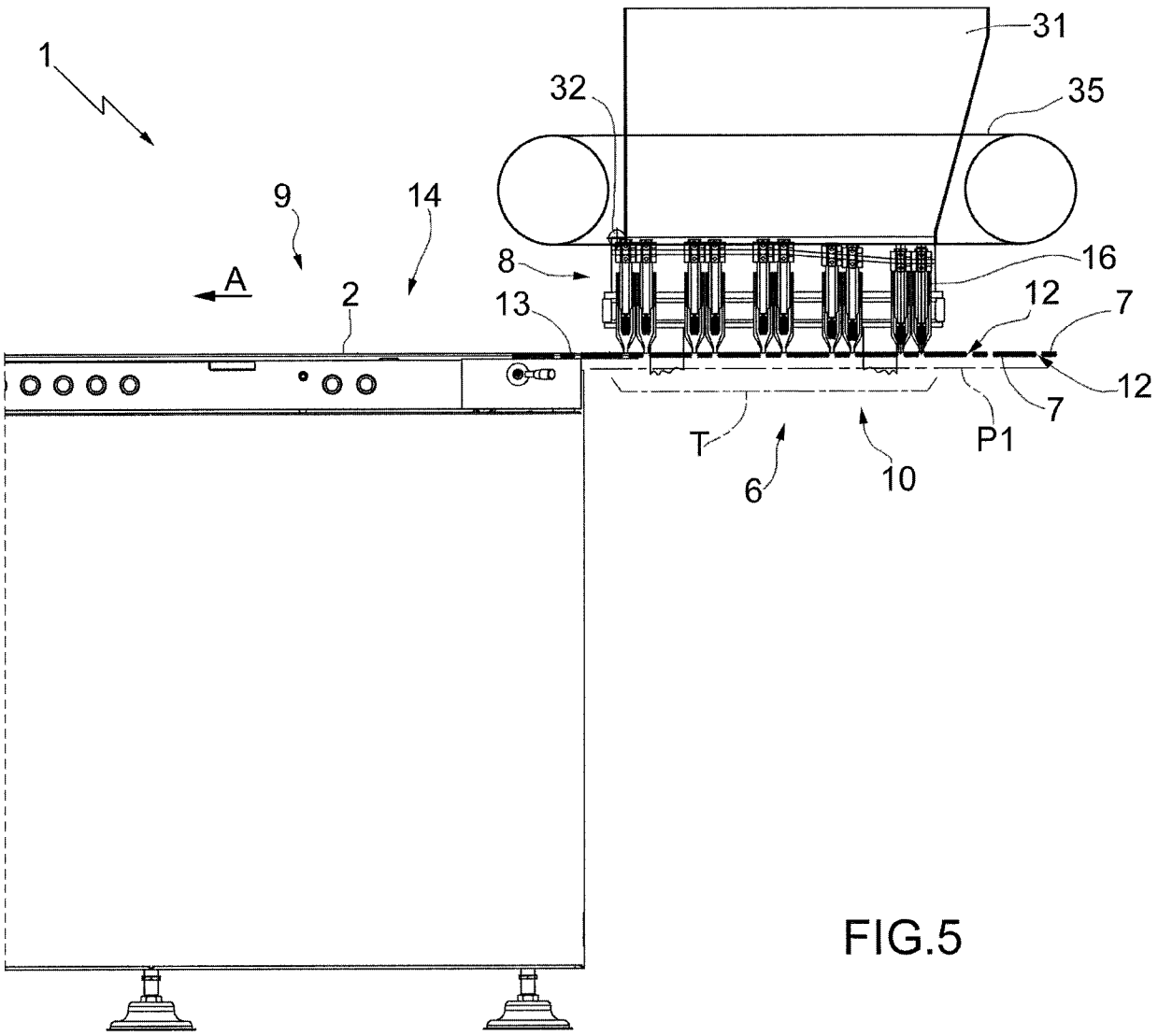
FIG. 5 is a lateral, schematic view, with some details removed for greater clarity and partly cross-sectional, of a further embodiment of a machine according to the present invention.
Figure 6:
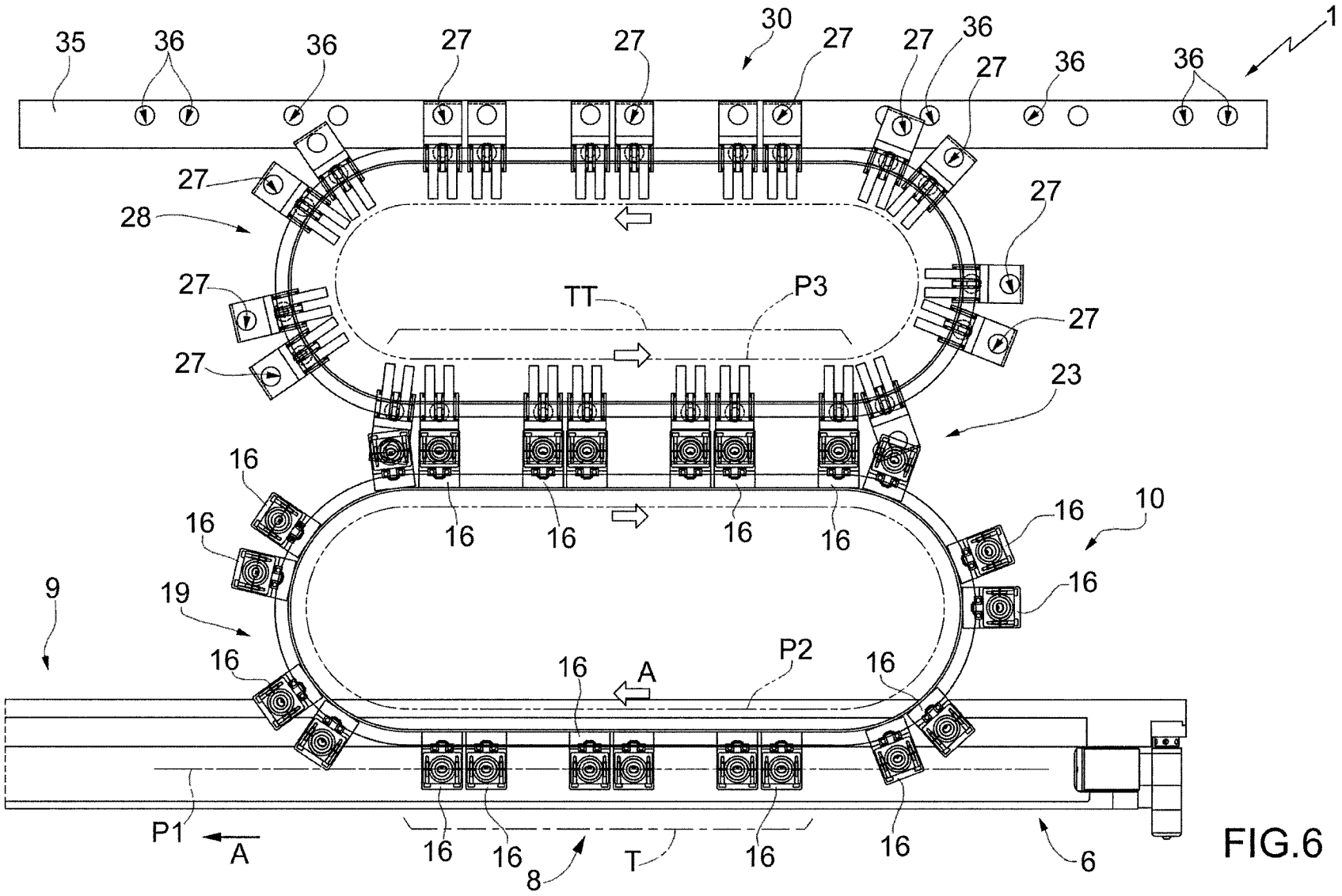
FIG. 6 is a view from above, with some details removed for greater clarity and on a larger scale, of a part of the machine of FIG. 5.
Figure 7:
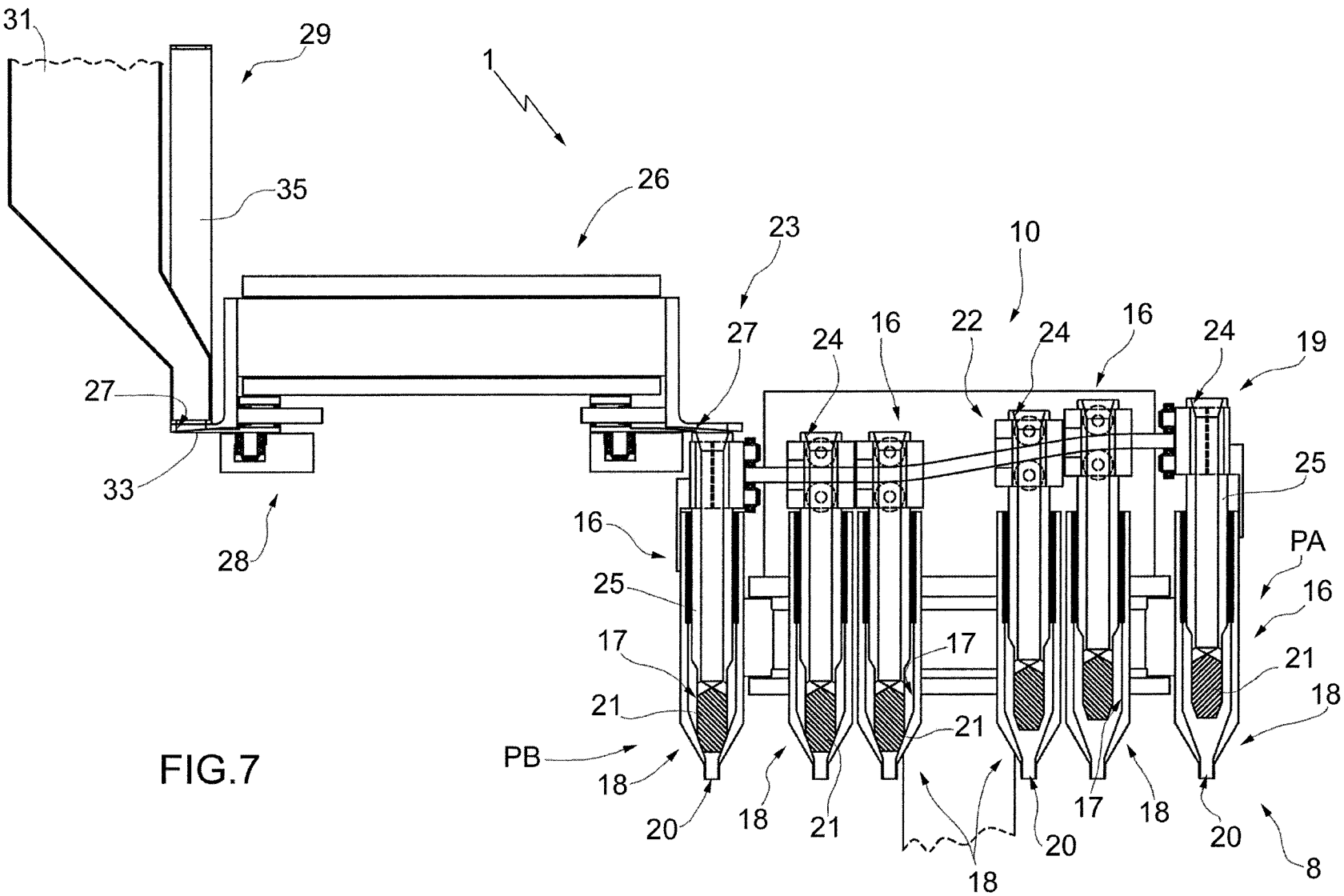
FIG. 7 is a front view, on a larger scale and with some details removed for greater clarity and partly cross-sectional, of a part of the machine of FIG. 5.

The embodiment of FIGS. 5-7 is substantially similar to the embodiment of FIGS. 1-4 and the only partial difference lies in the structure and operation of the loading assembly 26.

According to some embodiments, in particular with reference to FIGS. 5, 6 and 7, the seat 27 is a hole made in an L-shaped bracket, which is conveyed along the given path P3, which extends (completely) horizontally. The retaining assembly 33 comprises a fixed support, which extends (under the seat 27) along the path P3 at least between the metering station 30 and the loading station 23, but is absent in the portion TT. The loading assembly 26 also comprises, in this case, a belt 35, which is mounted so as to slide along a path having a portion that extends in the area of the lower opening of the hopper 31. The belt 35 has a hole 36, which is designed to be kept in phase with the seat 27, as the seat moves under the hopper 31. In this way, the loose material 11 can be fed to the seat 27 by passing through the hole 36, but it is prevented from moving out of the hopper 31 in other areas of its lower opening.

According to some embodiments (such as the ones shown in the drawings), the machine 1 comprises a plurality of insertion units 16 and of seats 27 (and possibly of holes 36), said insertion units 16 and seats 27 (and possibly holes 36) being like the ones described above and being active at the same time (though not necessarily in the same steps), so as to obtain a continuous operation of the machine 1.

Advantageously, the machine 1 comprises a vibrating system to cause the hopper 31 and the seat 27 (and/or the belt 35) to vibrate relative to each other. By so doing, operators can improve the way in which the loose material 11 moves out of the hopper 31 and is transferred to the seat 27.

According to some embodiments, the vibrating system (of a known type and not shown) is designed to cause the hopper 31 to vibrate.

As an alternative or in addition thereto, the vibrating system is designed to cause the belt 34 or the belt 35 (based on the embodiments) to vibrate.

According to a further aspect of the present invention, there is provided a method for producing a rod for substantially cylindrical articles of the tobacco processing industry.

In particular, the method is implemented by a machine 1 as described above.

In particular, each article 3 (FIG. 8) has portions 4 and 5 of different materials.

The method comprises a feeding step, during which a material 7 is fed, in a conveying direction A along a first given path P1, through an insertion station 8 and to a wrapping station 9. The material 7 has cavities 12 arranged in succession in the conveying direction A.

According to preferred embodiments, the articles 3 are cigarette filters and the material 7 comprises a filtering material, in particular cellulose acetate or the like.

Advantageously, the material 7 has portions of material that are arranged in succession in the conveying direction and alternate with the cavities 12.

The method comprises, furthermore, an insertion step, during which a given amount of a loose material 11 is inserted into the cavities 12 in the insertion station 8, so as to form a strand 13; and a wrapping and stabilizing step, during which a strip 15 is wrapped around the strand 13 and stabilized around the strand 13 itself in the wrapping station 9.

In particular, the loose material 11 is in the form of particles and/or granules (and/or fibres). For example, the loose material 11 can comprise a filtering material and/or tobacco particles.

Advantageously, an insertion unit 16, which comprises a loading chamber 17 to hold the given amount of loose material and an unloading device 18 to unload the loose material 11 from the loading chamber 17, is moved up to the material 7, so that the unloading device 18 faces a respective cavity 12.

In particular, during the insertion step and the feeding step, the insertion unit 16 is moved in the conveying direction A along at least one coupling portion T of the given path P1, so that the unloading device 18 is kept facing the respective cavity 12 as the loose material 11 is fed from the insertion unit into the cavity 7 (as the insertion unit 16 and the material 7 are moved along the coupling portion T itself).

According to some embodiments, the method comprises a conveying step, during which the insertion unit 16 is conveyed along a given path P2, which shares, with the given path P1, at least the coupling portion T.

In particular, the coupling portion T is defined as the portion T described above with reference to the machine 1.

According to some embodiments, the method comprises a loading step, during which the given amount of loose material 11 is transferred into the loading chamber 17.

Advantageously, during the conveying step, the insertion unit 16 is conveyed along the given path P2 through a loading station 23, in the area of which the loading step is carried out.

Advantageously, the path P2 is defined as the path P2 described above with reference to the machine 1.

In particular, during the conveying step, the insertion unit 16 is moved continuously along said second given path P2 (at a constant speed).

According to some embodiments, the method comprises a metering step, during which a transfer seat 27 with a given volume is filled with the loose material 11, so as to obtain said given amount.

In particular, during the loading step, the given amount of loose material 11 is transferred from said transfer seat 27 to the loading chamber 17.

According to some embodiments, the method comprises a transportation step, during which the transfer seat is conveyed along a given path P3 through a metering station 30, in the area of which the metering step is carried out, and through the loading station 23, in the area of which the loading step is carried out Advantageously, the path P3 is defined as the path P3 described above with reference to the machine 1.

In particular, during the metering step, the transfer seat 27 moves past an opening in a hopper 31 containing the loose material 11.

In particular, the given paths P2 and P3 share (at least) a transfer portion TT, which is located in the loading station 23 and along at least part of which the transfer seat 27 is coupled to, more specifically overlaps, the insertion unit 16, so as to transfer the given amount of loose material 11 from the transfer seat 27 to the insertion unit 16 (as the insertion unit 16 and the seat 27 are moved along the transfer portion TT itself).

More precisely, the transfer seat 27 and the insertion unit 16 move along the shared transfer portion TT in a coupled manner (at the same speed).

Advantageously, during the insertion step, the material 7 and the insertion unit 16 are fed continuously in the conveying direction A (at a substantially constant speed).

Advantageously, the transfer seat 27 is conveyed continuously along the given path P2 (at a substantially constant speed).

According to some embodiments, the loading, conveying and insertion steps are repeated many times; in particular, during the conveying step, the insertion unit 16 is moved continuously along said second path. Advantageously, the loading station 23 (in particular, the hopper 31) is offset relative to the (namely, not directly above the) path P1 and relative to the (namely, not directly above the) wrapping station 9. In this way, the quality of the rod 2 is further improved.

The invention claimed is:

1. A method for producing a rod for substantially cylindrical articles of a tobacco processing industry; each article comprising portions of different materials; the method comprising:

a metering step, during which a transfer seat is filled with a given amount of the loose material, wherein the transfer seat has a given volume selected such that filling the transfer seat results in the transfer seat housing the given amount of loose material, and a retaining assembly comprising a physical barrier arranged below the transfer seat during the metering step to prevent the loose material from going out of the transfer seat;

a loading step, during which the given amount of loose material is transferred from the transfer seat to a loading chamber of an insertion unit, and the retaining assembly is absent during the loading step such that the given amount of loose material can be transferred from the transfer seat during the loading step;

a feeding step, during which a first material is fed, in a conveying direction along a first given path, through an insertion station and to a wrapping station; the first material having cavities arranged in succession in the conveying direction;

an insertion step, during which the given amount of a loose material is inserted into the cavities in the insertion station, so as to form a strand; and a wrapping and stabilizing step, during which a strip is wrapped around the strand and stabilized around the strand itself in the wrapping station, wherein the insertion unit comprises an unloading device to unload the given amount of the loose material from the loading chamber, during the insertion step the insertion unit is moved into the area of the first material, so that the unloading device faces one of the cavities;

during the insertion step and the feeding step, the insertion unit is moved in the conveying direction along at least one coupling portion of the first given path, so that the unloading device is kept facing the respective cavity as the loose material is fed from the insertion unit into the cavity.

2. A method according to claim 1, and comprising a conveying step, during which the insertion unit is conveyed along a second given path, which shares, with the first given path, at least said coupling portion, which is substantially straight.

3. A method according to claim 1, and comprising a transportation step, during which the transfer seat is conveyed along a third given path through a metering station, in the area of which the metering step is carried out, and through a loading station, in the area of which the loading step is carried out.

4. A method according to claim 1, and comprising a feeding device, which is designed to feed the loose material to the transfer seat.

5. A method according to claim 1, wherein, during the insertion step, the first material and the insertion unit are fed continuously in the conveying direction.

6. A method according to claim 1, wherein the first material has portions of material that are arranged in succession in the conveying direction and alternate with said cavities.

7. A method according to claim 1, wherein the loose material is in the form of particles and/or fibers and/or granules.

8. A method according to claim 2, wherein the coupling portion is at least 2.5 cm and up to 30 cm long.

9. A method according to claim 2, wherein during the conveying step, the insertion unit is conveyed along the second given path through a loading station, in the area of which the loading step is carried out.

10. A method according to claim 1, during the metering step, the transfer seat moves at an opening of a hopper containing the loose material.

11. A method according to claim 3, wherein the second and third given paths share at least a transfer portion, which is located in the area of the loading station and along which the transfer seat is coupled to the insertion unit, so as to transfer the given amount of loose material from the transfer seat to the insertion unit.

12. A method according to claim 4, wherein the feeding device comprises a hopper, which has a lower opening, through which the loose material is fed into the transfer seat.

13. A method according to claim 2, wherein, during the conveying step, the insertion unit is moved continuously along said second given path.

14. A method according to claim 12 wherein the transfer seat is conveyed continuously along the third given path.

* * * * *